US006702020B2

(12) United States Patent
Zachman et al.

(10) Patent No.: US 6,702,020 B2
(45) Date of Patent: Mar. 9, 2004

(54) CROSSOVER TOOL

(75) Inventors: James R. Zachman, The Woodlands, TX (US); Christian F. Bayne, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/120,659

(22) Filed: Apr. 11, 2002

(65) Prior Publication Data

US 2003/0192694 A1 Oct. 16, 2003

(51) Int. Cl.[7] ..... E21B 43/02
(52) U.S. Cl. ..... 166/278; 166/51; 166/334.4
(58) Field of Search ..... 166/278, 51, 276, 166/319, 320, 334.4

(56) References Cited

U.S. PATENT DOCUMENTS 2,994,280 A 8/1961 Daffin
4,424,864 A 1/1984 Logan
4,427,070 A 1/1984 O'Brien
4,520,870 A 6/1985 Pringle
5,411,095 A 5/1995 Ehlinger et al.
5,597,040 A 1/1997 Stout et al.
5,823,254 A 10/1998 Dobson et al.
6,311,772 B1 11/2001 Myhre et al.
6,464,006 B2 * 10/2002 Womble ..... 166/276

FOREIGN PATENT DOCUMENTS

EP 1225302 A2 4/2002

* cited by examiner

*Primary Examiner*—William Neuder
(74) *Attorney, Agent, or Firm*—Steve Rosenblatt

(57) ABSTRACT

A crossover tool is disclosed that permits access through to the wash pipe below after the conclusion of a known gravel packing operation. A ball is trapped to a sleeve after shifting it so as to allow flow through the crossover for acid treatment in the screen area and a reversing out procedure to remove excess acid. Alternatively, pressure delivered through the wash pipe can operate packers, as part of a gravel packing procedure as outlined in two steps in U.S. Pat. No. 6,311,772 is a single trip. The acid treating or other downhole operation through the wash pipe can also be accomplished in a single trip with the gravel packing assembly.

22 Claims, 4 Drawing Sheets

CROSSOVER TOOL

FIELD OF THE INVENTION

The field of this invention is crossover tools frequently used in gravel packing operations and features of such tools post gravel packing, which allow chemical treating or packer inflation.

BACKGROUND OF THE INVENTION

Crossover tools are frequently used in performing gravel-packing operations. They allow the gravel to pass through a packer and exit to an annular space outside one or more screens. The returns pass through the screen up a wash pipe and back through the crossover and out into the annulus above the packer for the trip to the surface. After deposition of the gravel, the crossover tool is picked up so that remaining gravel in the tubing can be reversed out with fluid pumped down the annulus above the packer.

Following gravel pack operation, the need may arise to acid treat the gravel pack area around the screens. In the past the gravel packing service tool assembly, including the crossover had to be pulled out and the treating string run in. The present invention presents a crossover tool with modifications to allow pumping down the string through the crossover tool, after the gravel packing operation is concluded so as to eliminate a trip out of the hole for acid treating. It also allows the excess chemical to be reversed out using a unique assembly that captures a plug that was used to shift a sleeve, on that sleeve during reverse flow.

In prior gravel packing techniques that used isolators in conjunction with the screens, it was also the practice to pull the gravel packing assembly, including the cross-over, and run in with another string to selectively inflate the external casing packers in the gravel pack zone. The present invention with the access provided through the crossover tool after the gravel packing allows such packers to be inflated in the same trip. This prior two-trip procedure is illustrated in U.S. Pat. No. 6,311,772. With the present invention the technique described in that patent can be streamlined.

Relevant patents that show gravel packing or sliding sleeve devices in downhole tools are U.S. Pat. Nos. 2,994,280; 4,424,864; 4,427,070; 4,520,870; 5,411,095; 5,597,040 and 5,823,254.

Those skilled in the art will be better able to appreciate the value of the invention from a description of the preferred embodiment and the claims below.

SUMMARY OF THE INVENTION

A crossover tool is disclosed that permits access through to the wash pipe below after the conclusion of a known gravel packing operation. A ball is trapped to a sleeve after shifting it so as to allow flow through the crossover for acid treatment in the screen area and a reversing out procedure to remove excess acid. Alternatively, pressure delivered through the wash pipe can operate packers, as part of a gravel packing procedure as outlined in two steps in U.S. Pat. No. 6,311,772 is a single trip. The acid treating or other downhole operation through the wash pipe can also be accomplished in a single trip with the gravel packing assembly.

DETAILED DESCRIPTION OF THE DRAWINGS

DETAILED DESCRIPTION OF THE PREFERRED EMBODIMENT

Figure 1:
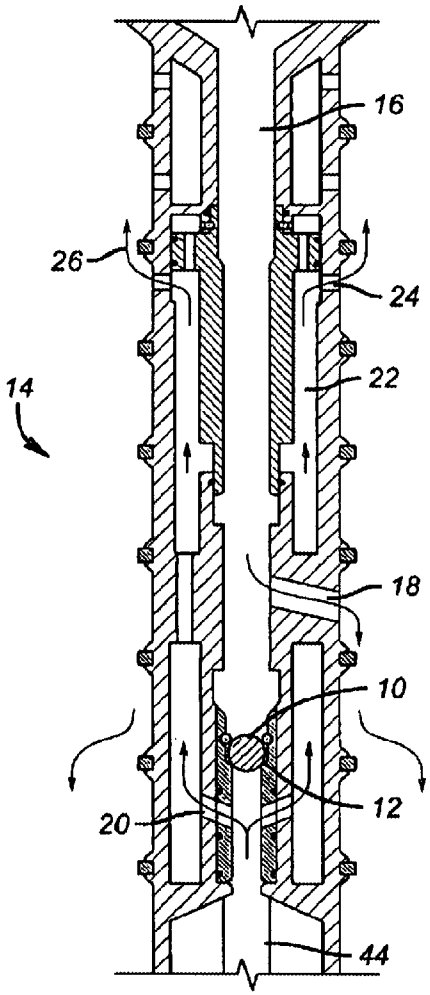
FIG. 1 is an elevation view of the crossover in the gravel packing operation.

FIG. 1 shows the crossover of the present invention in the gravel packing position. A ball 10 is dropped onto a seat 12. The gravel is pumped through a packer (not shown) through which the crossover tool 14 extends. The gravel goes down passage 16 and out lateral port 18. Returns come through the screen (not shown) and into ports 20 just below ball 10. The flow is through an annular passage 22 in the crossover tool 14 and out above the packer (not shown) through ports 24 as indicated by arrows 26. In this manner, the crossover tool 14 accomplishes gravel deposition in the manner previously known.

Figure 2:
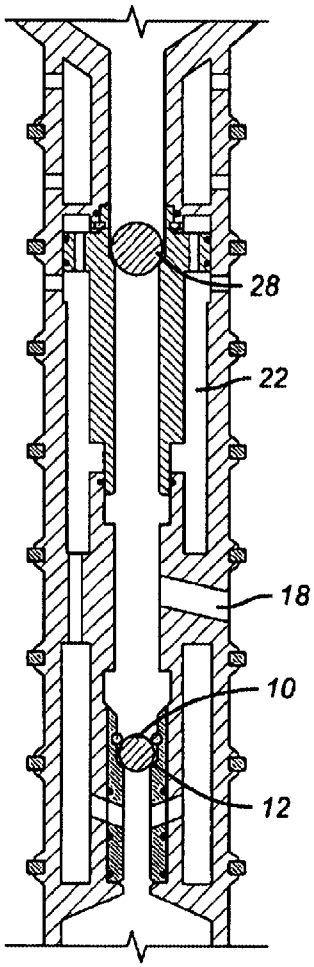
FIG. 2 is the view of FIG. 1 with the upper ball dropped after the conclusion of the gravel packing operation.
Figure 4:
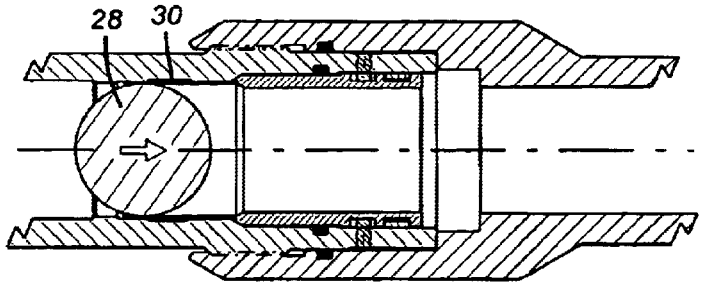
FIG. 4 is a close-up of the ball approaching the upper seat.
Figure 5:
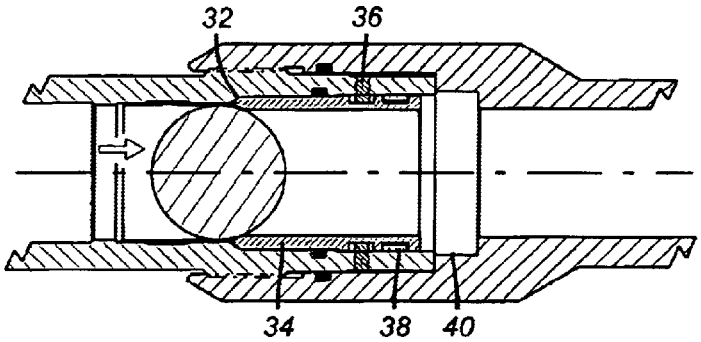
FIG. 5 is the view of FIG. 4 with the ball passing the upper seat and moving into contact with the sliding sleeve.
Figure 6:
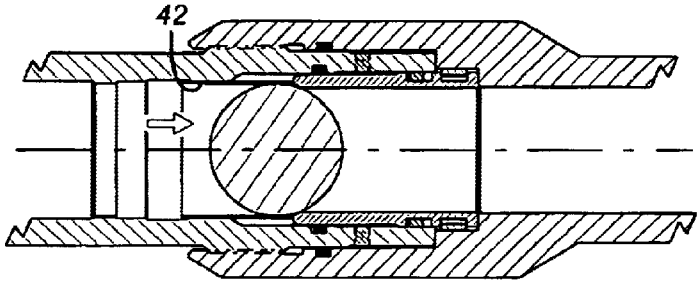
FIG. 6 is the view of FIG. 5 with pressure applied on the ball to shift the sleeve.
Figure 7:
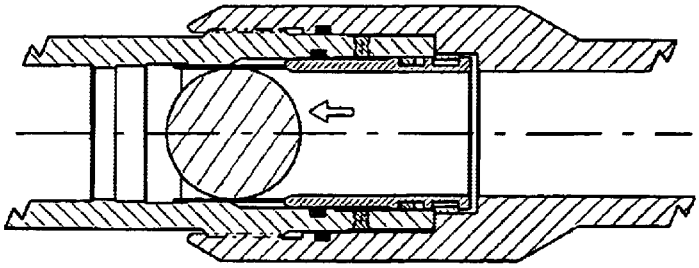
FIG. 7 is the view of FIG. 6 with pressure coming from below and showing the ball trapped by the upper seat.

FIG. 2 shows the ball 28 having been dropped down. That sequence is more clearly shown in FIGS. 4–7. In FIG. 4, the ball 28 lands on a thin sleeve 30 which acts as the initial ball seat. Upon pressure buildup, the ball 28 is forced past sleeve 30 and into sealing contact with seat 32 on sleeve 34. Sleeve 34 is an extension of sleeve 30. A shear pin 36 holds sleeve 34 in its initial position. A snap ring 38 is mounted to sleeve 34 and it is able to snap out into recess 40 when sleeve 34 shifts as a result of applied pressure to ball 28 when on seat 32. This movement is shown in FIG. 6. As a result of this movement, the internal diameter of sleeve 30, through which ball 28 has already been forced, is further reduced as it is pulled through a reduced diameter of a surrounding body 42. The ball 28 is locked onto seat 32. FIG. 7 shows pressure from below to a predetermined level, cannot dislodge the ball 28. This can occur during a reversing out procedure after an acid treatment or some other downhole procedure, as will be explained below.

Figure 3:
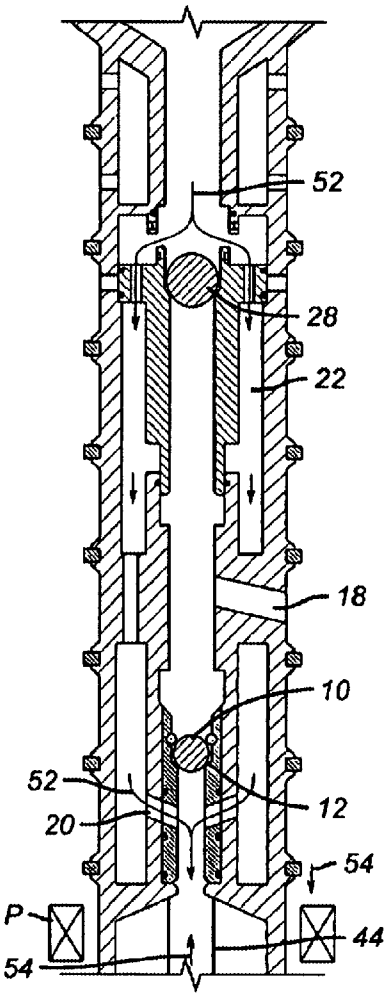
FIG. 3 is the view of FIG. 2 showing the flow for treating or other downhole operation through the crossover after gravel packing.
Figure 8:
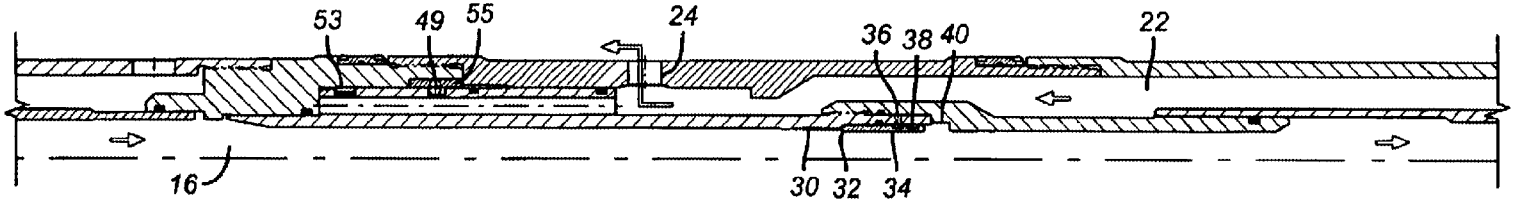
FIG. 8 is a close-up view of the crossover during the gravel packing operation.
Figure 9:
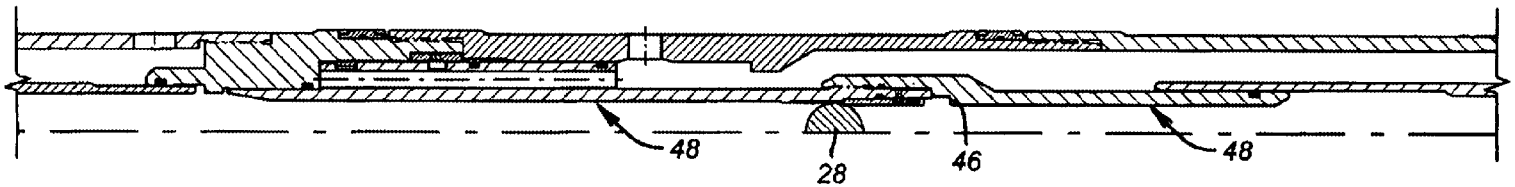
FIG. 9 is the view of FIG. 8 with the ball past the initial seat and trapped against the sliding sleeve.
Figure 10:
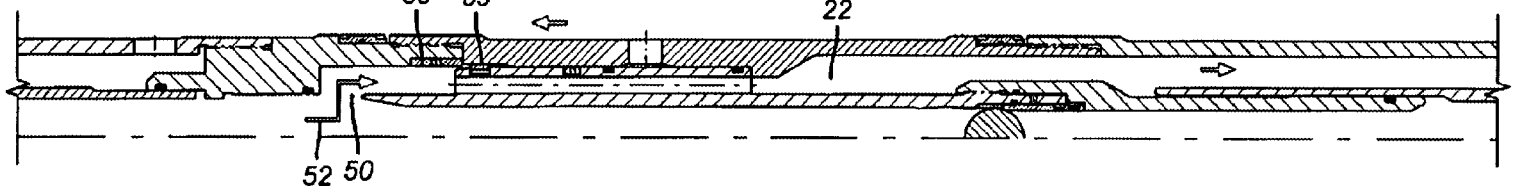
FIG. 10 is the view of FIG. 9 showing the sleeve assembly shifted to permit the downhole operation through the crossover after gravel packing.

FIGS. 8–10 illustrate the normal gravel packing position and subsequent positions. These Figures show in detail portions for the crossover tool 14 illustrated in FIGS. 1–3. In the gravel-packing step, the ball 10 (see FIG. 1) is in position and gravel is pumped down passage 16. Eventually the gravel exits port 18 (see FIG. 1) and the returns go through the screen (not shown) into a wash pipe 44 and into annular passage 22 to exit at ports 24. Ports 24 are located above a packer (not shown) and the returns from gravel packing go to the surface in the annulus above this packer. FIG. 8 also indicates the position of thin sleeve 30, seat 32, sleeve 34, shear pin 36, snap ring 38, and recess 40. FIG. 9 shows that when the sleeve 34 is displaced due to pressure on ball 28, it bottoms on shoulder 46 on sleeve assembly 48. After buildup of sufficient pressure on ball 28, sleeve 34 takes sleeve assembly 48 with it, as shear pin 49 shears, to open passages 50 into annular passage 22, through passages 51, and to close ports 24. The shifted position is secured by keeper ring 53 expanding past the stop ring 55. Referring to FIGS. 3 and 10, flow can come from the surface through the tubing (not shown) that supports the crossover 14 and into passages 50 as shown by arrows 52. Referring to FIG. 3, the flow continues down annular passage 22 to ports 20, as indicated by arrows 52. Flow then goes through the wash pipe 44 to the area of the screens (not shown). Those skilled in the gravel packing art will readily see that in a single trip, the gravel packing can be accomplished in the previously done manner and that access to the screen area is obtainable for acid treating or for inflation of external packers into the gravel pack or for other downhole operations which require flow through the crossover tool 14. The single trip capability comes from not having to pull the crossover tool 14 after the gravel pack to gain access to the screen area through the wash pipe.

If doing an acid treatment, it may be desirable to reverse out any excess acid. To do this, the crossover tool 14 is picked up out of the packer, just like when the ball 28 is first dropped onto sleeve 30, so that only the wash pipe 44 is still in the packer P, shown schematically in FIG. 3. Reverse flow, indicated by arrows 54 comes down outside the crossover tool 14 and goes down into and back up through the wash pipe 44. It should be noted that the reversing flow, indicated by arrows 54 has to go right past openings 18. It would normally enter there and go up hole through passage 16, except for the fact that ball 28 is sealingly retained against seat 32 to prevent uphole flow (see FIG. 7). What happens is that the reverse flow shown by arrow 54 forces ball 10 down against its seat 12 and the reverse flow path is now in the opposite direction as arrows 52 after entering the wash pipe 44. In essence, the reverse flow bypasses trapped ball 28 as it re-enters passage 16 above it for the trip to the surface. Ball 10 is held against its seat 12 by a higher pressure above it than the returning flow represented by arrow 54, which comes in below it.

Different pressure levels on ball 28 can trigger the described movements. For example at 200–500 pounds per square inch (PSI), ball 28 will go through sleeve 30. At 750–800 PSI the snap ring 38 will go into recess 40 trapping ball 28. At 1400–1600 the sleeve assembly 48 will move down after breaking shear pins 49 opening passages 50, to get access to annular passage 22 through passages 51. Other non-overlapping pressure ranges can be used.

Figure 11:
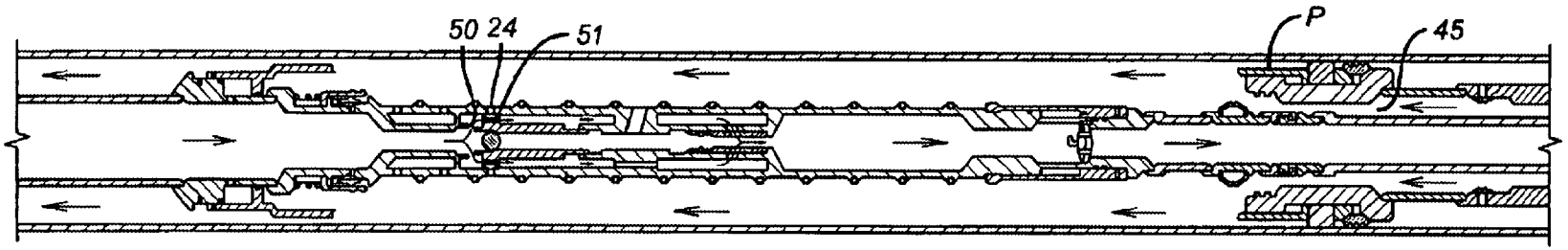
FIG. 11 is a view of the crossover during a subsequent operation below it in a single trip and showing the position of the wash pipe with respect to the packer.

FIG. 11 is an illustration of access through the crossover tool 14 after dropping trapping and shifting ball 28. It shows the wash pipe 44 lifted up with respect to packer P to open return passage 45 when performing a downhole treatment or other task through the crossover tool 14 after gravel packing and without an addition trip into the hole. Those skilled in the art will appreciate that a variety of tasks can be done below the crossover tool 14 after gravel packing without another trip into the hole.

While the preferred embodiment has been described above, those skilled in the art will appreciate that other mechanisms are contemplated to accomplish the task of this invention, whose scope is delimited by the claims appended below, properly interpreted for their literal and equivalent scope.

We claim:

1. A multi-position crossover tool for depositing gravel outside a screen and below a packer, comprising:

a body, having an uphole and a downhole end, and having a first passage system therethrough comprising a downflow component, beginning adjacent said uphole end, to allow gravel to exit the tool through a gravel outlet for deposition outside of said body and the screen and below the packer, and an upflow component beginning adjacent said downhole end, to accept returns coming through the screen and channel them through said body to a return port in communication with an annular space outside said body and above the packer; and a valve member in said body operable in said body at least in part by dropping an object onto a seat to selectively reconfigure said first passage system into a second passage system incorporating portions of said downflow and upflow components to allow downflow through said body toward said screen.

2. The tool of claim 1, wherein:

said valve member comprises a selective closure in a portion of said downflow component and a selective communication between said uphole and downhole components, uphole of said valve member.

3. A multi-position crossover tool for depositing gravel outside a screen and below a packer, comprising:

a body, having an uphole and a downhole end, and having a first passage system therethrough comprising a downflow component, beginning adjacent said uphole end, to allow gravel to exit the tool through a gravel outlet for deposition outside of said body and the screen and below the packer, and an upflow component beginning adjacent said downhole end, to accept returns coming through the screen and channel them through said body to a return port in communication with an annular space outside said body and above the packer;

a valve member in said body to selectively reconfigure said first passage system into a second passage system incorporating portions of said downflow and upflow components to allow downflow through said body toward said screen; and said valve member is disposed between said uphole end and said gravel outlet in said body.

4. The tool of claim 3, wherein:

said valve member comprises a shifting sleeve that selectively closes said return port while opening a passage between said downhole and uphole components.

5. The tool of claim 4, wherein:

said valve member comprises an object that is insertable through said uphole end to engage said sleeve for sealing said downflow component.

6. The tool of claim 5, wherein:

said object is trapped by said sliding sleeve against flow entering said body from said gravel outlet.

7. The tool of claim 6, wherein:

movement of said sliding sleeve reduces its internal dimension to trap said object adjacent a seat located on said sliding sleeve.

8. The tool of claim 7, wherein:

said downflow component comprises a central passage through said body which is initially blocked by a ball, before said object is introduced, so that gravel is directed from said central passage to said gravel outlet;

said upflow component comprises an annular passage in said body surrounding said central passage, said ball causing said returns, before said object is inserted, to divert into said annular passage and out through said return port;

whereupon insertion of said object and shifting said sleeve allows said central passage above the object to communicate with said annular passage for downflow or upflow through said annular passage beyond said object and said ball.

9. The tool of claim 8, wherein:

said sleeve retains said object to said seat upon upflow through said annular passage that is initiated by flow outside said body, which communicates to said central passage through said gravel outlet.

10. The tool of claim 7, wherein:

said sliding sleeve comprises an inner sleeve comprising said seat and an outer sleeve which opens said passage between said downhole and uphole components;

said inner sleeve moving relative to said outer sleeve to secure said object.

11. The tool of claim 10, wherein:

said inner sleeve locks to said outer sleeve after shifting to trap said object and said outer sleeve locks to said body after shifting to open said passage between said uphole and downhole components.

12. A method for one trip gravel packing and conducting a subsequent operation, comprising:

running in a gravel packing assembly comprising a packer, a crossover and a screen;

depositing gravel through a gravel outlet below the packer and outside the screen in a downflow path and taking returns through said crossover to above said packer through a return opening in an upflow path;

reconfiguring said upflow and downflow paths in said crossover by driving an object against a seat to allow flow through said crossover and down to inside said screen; and performing a downhole operation through said crossover after said reconfiguring in the same trip into the well.

13. The method of claim 12, comprising:

using part of said upflow path for downflow.

14. The method of claim 13, comprising:

surrounding said downflow path with said upflow path;

blocking said downflow path with an object dropped on a sliding sleeve;

moving said sliding sleeve to open communication between said paths for flow around said object.

15. A method for one trip gravel packing and conducting a subsequent operation, comprising:

running in a gravel packing assembly comprising a packer, a crossover and a screen;

depositing gravel through a gravel outlet below the packer and outside the screen in a downflow path and taking returns through said crossover to above said packer through a return opening in an upflow path;

reconfiguring said upflow and downflow paths in said crossover to allow flow through it and down to inside said screen; and performing a downhole operation through said crossover after said reconfiguring in the same trip into the well;

using part of said upflow path for downflow;

surrounding said downflow path with said upflow path;

blocking said downflow path with an object dropped on a sliding sleeve; moving said sliding sleeve to open communication between said paths for flow around said object; and closing said return opening when shifting said sleeve.

16. A method for one trip gravel packing and conducting a subsequent operation, comprising:

running in a gravel packing assembly comprising a packer, a crossover and a screen;

depositing gravel through a gravel outlet below the packer and outside the screen in a downflow path and taking returns through said crossover to above said packer through a return opening in an upflow path;

reconfiguring said upflow and downflow paths in said crossover to allow flow through it and down to inside said screen; and performing a downhole operation through said crossover after said reconfiguring in the same trip into the well;

using part of said upflow path for downflow;

surrounding said downflow path with said upflow path;

blocking said downflow path with an object dropped on a sliding sleeve;

moving said sliding sleeve to open communication between said paths for flow around said object; and trapping said object to a seat on said sleeve as a result of shifting said sleeve.

17. The method of claim 16, wherein:

providing an inner sleeve with said seat and an outer sleeve;

shifting said inner sleeve with respect to said outer sleeve to trap said object to said seat;

shifting said outer sleeve in tandem with said inner sleeve while said object is trapped to said seat, to open said downflow path above said object into said surrounding upflow path.

18. The method of claim 17, comprising locking said inner sleeve to said outer sleeve after it shifts; and locking said outer sleeve to the crossover body after it shifts.

19. A method for one trip gravel packing and conducting a subsequent operation, comprising:

running in a gravel packing assembly comprising a packer, a crossover and a screen;

depositing gravel through a gravel outlet below the packer and outside the screen in a downflow path and taking returns through said crossover to above said packer through a return opening in an upflow path;

reconfiguring said upflow and downflow paths in said crossover to allow flow through it and down to inside said screen; and performing a downhole operation through said crossover after said reconfiguring in the same trip into the well;

using part of said upflow path for downflow;

surrounding said downflow path with said upflow path;

blocking said downflow path with an object dropped on a sliding sleeve;

moving said sliding sleeve to open communication between said paths for flow around said object;

initially blocking a portion of said downflow path with a ball to direct gravel out through said gravel outlet; and inserting said object above said ball in said downflow path such that said moving of said sliding sleeve allows flow to exit said downflow path and bypass said object and said ball in said surrounding upflow path before returning internally to said downflow path.

20. The method of claim 19, comprising:

allowing bi-directional bypass flow around said object and said ball with said object trapped to a seat on said sleeve.

21. A multi-position crossover tool for depositing gravel outside a screen and below a packer, comprising:

a body, having an uphole and a downhole end, and having a first passage system therethrough comprising a downflow component, beginning adjacent said uphole end, to allow gravel to exit the tool through a gravel outlet for deposition outside of said body and the screen and below the packer, and an upflow component beginning adjacent said downhole end, to accept returns coming through the screen and channel them through said body to a return port in communication with an annular space outside said body and above the packer;

a valve member in said body to selectively reconfigure said first passage system into a second passage system incorporating portions of said downflow and upflow components to allow downflow through said body toward said screen;

said valve member comprises a shifting sleeve that selectively closes said return port while opening a passage between said downhole and uphole components.

22. A method for one trip gravel packing and conducting a subsequent operation, comprising:

running in a gravel packing assembly comprising a packer, a crossover and a screen;

depositing gravel through a gravel outlet below the packer and outside the screen in a downflow path and taking returns through said crossover to above said packer through a return opening in an upflow path;

reconfiguring said upflow and downflow paths in said crossover to allow flow through it and down to inside said screen;

performing a downhole operation through said crossover after said reconfiguring in the same trip into the well closing said return opening with said reconfiguring.

* * * * *

US006702020C1

(12) EX PARTE REEXAMINATION CERTIFICATE (7297th)

United States Patent
Zachman et al.

(10) Number: US 6,702,020 C1
(45) Certificate Issued: Jan. 5, 2010

(54) CROSSOVER TOOL

(75) Inventors: James R. Zachman, The Woodlands, TX (US); Christian F. Bayne, The Woodlands, TX (US)

(73) Assignee: Baker Hughes Incorporated, Houston, TX (US)

Reexamination Request:
No. 90/010,063, Jan. 8, 2008

Reexamination Certificate for:

| | |
|---|---|
| Patent No.: | **6,702,020** |
| Issued: | **Mar. 9, 2004** |
| Appl. No.: | **10/120,659** |
| Filed: | **Apr. 11, 2002** |

(30) Foreign Application Priority Data

Apr. 2, 2002 (EP) ..... 1225302

(51) Int. Cl.
*E21B 43/02* (2006.01)

(52) U.S. Cl. ..... 166/278; 166/51; 166/334.4

(58) Field of Classification Search ..... None
See application file for complete search history.

(56) References Cited

U.S. PATENT DOCUMENTS 6,571,875 B2 6/2003 Bissonnette et al.

*Primary Examiner*—Jeffrey L. Gellner

(57) ABSTRACT

A crossover tool is disclosed that permits access through to the wash pipe below after the conclusion of a known gravel packing operation. A ball is trapped to a sleeve after shifting it so as to allow flow through the crossover for acid treatment in the screen area and a reversing out procedure to remove excess acid. Alternatively, pressure delivered through the wash pipe can operate packers, as part of a gravel packing procedure as outlined in two steps in U.S. Pat. No. 6,311,772 is a single trip. The acid treating or other downhole operation through the wash pipe can also be accomplished in a single trip with the gravel packing assembly.

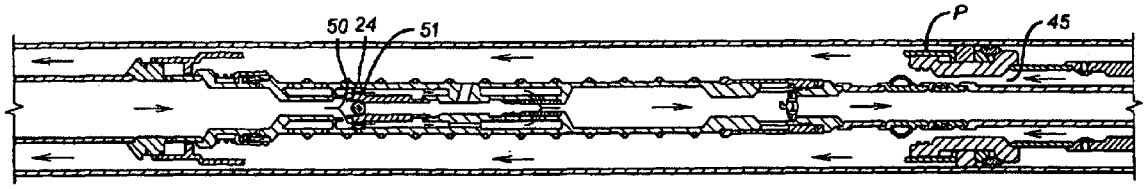

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 3, 12 and 16 are cancelled.

Claims 2, 4–11, 13–15 and 17–22 were not reexamined.

* * * * *